US006753052B2

(12) United States Patent
Yamamoto et al.

(10) Patent No.: US 6,753,052 B2
(45) Date of Patent: Jun. 22, 2004

(54) HEAT TRANSFER SHEET AND LIGHT-HEAT-CONVERSION TYPE IMAGE-FORMING MATERIAL

(75) Inventors: Mitsuru Yamamoto, Shizuoka-ken (JP); Kosaku Yoshimura, Shizuoka-ken (JP); Kazuhito Miyake, Shizuoka-ken (JP); Hideyuki Nakamura, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 99 days.

(21) Appl. No.: 09/836,233

(22) Filed: Apr. 18, 2001

(65) Prior Publication Data

US 2002/0051868 A1 May 2, 2002

(30) Foreign Application Priority Data

Apr. 18, 2000 (JP) ..... 2000-117056
Apr. 18, 2000 (JP) ..... 2000-117057
Aug. 9, 2000 (JP) ..... 2000-240941

(51) Int. Cl.[7] ..... B41M 5/40
(52) U.S. Cl. ..... 428/32.81; 428/32.8
(58) Field of Search ..... 428/195, 484, 428/488.1, 488.4, 32.8

(56) References Cited

U.S. PATENT DOCUMENTS 6,383,621 B1 * 5/2002 Tojima et al. ..... 428/213

FOREIGN PATENT DOCUMENTS

JP 11-334230 12/1999

OTHER PUBLICATIONS

Patent Abstract of Japan, 11–334230, Dec. 7, 1999.

* cited by examiner

*Primary Examiner*—Bruce Hess
(74) *Attorney, Agent, or Firm*—Sughrue Mion, PLLC

(57) ABSTRACT

A heat transfer sheet in which a recorded image having excellent stability in storage and manifesting little variation in sensitivity and resolution can be obtained by adding an additive to a light-heat-conversion layer.

A heat transfer sheet comprising a light-heat-conversion layer which includes an infrared light absorbing colorant and an image formation layer, the layers being disposed in that order, on a support, wherein the above-mentioned light-heat-conversion layer further comprises at least one compound from any group selected from a) compounds having at least one functional group selected from a phosphate group, a phosphite group, an acid halide group, an acid anhydride group and an isocyanate group, b) compounds having an acidic group, c) compounds represented by the following general formula (10), and tautomers thereof, and compounds represented by the following general formula (13).

A—S—B General formula (10)

S=D General formula (13)

3 Claims, No Drawings

HEAT TRANSFER SHEET AND LIGHT-HEAT-CONVERSION TYPE IMAGE-FORMING MATERIAL

BACKGROUND OF THE INVENTION

1. Field of the Invention

The present invention relates to a heat transfer sheet and a light-heat-conversion type image forming material used in an image forming method in which an image having high resolution is formed using a laser beam. More particularly, the present invention relates to a heat transfer sheet and a light-heat-conversion type image-forming material in which deterioration of a light-heat-conversion layer due to the passage of time when the heat transfer sheet and the light-heat conversion type image forming material is stored or the like is prevented, and in which a transfer image showing no reduction in image quality is obtained.

2. Description of the Related Art

Conventionally, as a recording material used in a method of formation of transferred images using laser beam, heat transfer sheets are known in which a light-heat-conversion layer containing a light-heat-conversion colorant such as an infrared light absorbing colorant and the like and which light-heat-conversion layer absorbs laser beams and generates heat, and an image formation layer containing a pigment dispersed in components such as heat waxes which melt when heated, binder and the like, are provided in that order on a support. In an image forming method using this sheet, due to heat generated in regions irradiated with laser beam in the light-heat-conversion layer, portions of the image formation layer corresponding to these regions are melted, and transferred onto an image receiving material which has been laminated on the heat transfer sheet, to thereby form transferred images.

However, when a heat transfer sheet is stored, particularly when stored under conditions of high temperature and high humidity, problems occur such as decrease in sensitivity and deterioration of resolution. Further, even if a heat transfer sheet is stored at room temperature, when the period of storage is long, the problem of reduction in recording ability also arises. Further, even if the heat transfer sheet is stored before the formation of a light-heat-conversion layer, that is, even if a coating solution is stored, a problem exists that due to deterioration as a result of the passage of time, a desired optical density can not be obtained, leading to lowering of image quality.

SUMMARY OF THE INVENTION

An object of the present invention is to provide a heat transfer sheet and a light-heat-conversion type image forming material which are excellent in stability during storage and in which recorded images showing little variation in sensitivity and resolution can be obtained.

A first embodiment of the present invention is a heat transfer sheet comprising a light-heat-conversion layer which includes an infrared light absorbing colorant and an image formation layer, the layers being provided in that order on a support, wherein said light-heat-conversion layer further includes one or more compounds having at least one functional group selected from a phosphate group, a phosphite group, an acid halide group, a sulfonic halide group, an acid anhydride group and an isocyanate group.

A second embodiment of the present invention is a heat transfer sheet comprising a light-heat-conversion layer which includes an infrared light absorbing colorant and an image formation layer, the layers being provided in that order on a support, wherein said light-heat-conversion layer includes at least one of compounds having an acidic group.

A third embodiment of the present invention is a heat transfer sheet comprising a light-heat-conversion layer which includes an infrared light absorbing colorant and an image formation layer, the layer being provided in that order on a support, wherein said light-heat-conversion layer further includes at least one or more compounds selected from compounds represented by the following general formula (10) and tautomers thereof, and compounds represented by the following general formula (13):

A—S—B General formula (10)

wherein, A represents an aromatic ring or a heterocyclic ring which may have a substituent; B represents a hydrogen atom, —S—A', or —C(=O)$R^1$; A' represents an aromatic or heterocyclic ring which may have a substituent, and may be the same as said A; $R^1$ represents an alkyl group which may be branched, has 1 to 18 carbon atoms, and may include a functional group, S=D General formula (13)

wherein, D represents a 5-membered or 6-membered nitrogen-containing heterocyclic or aromatic ring; said aromatic or heterocyclic ring may have a substituent, and further, the aromatic or heterocyclic ring may be condensed.

A fourth embodiment of the present invention is a light-heat-conversion type image formation material comprising a heat transfer sheet and an image receiving material, wherein said heat transfer sheet comprises a light-heat-conversion layer which includes an infrared light absorbing colorant and an image formation layer, the layers being provided in that order on a support, wherein said light-heat-conversion layer further includes one or more compounds having at least one functional group selected from a phosphate group, a phosphite group, an acid halide group, a sulfonic halide group, an acid anhydride group and an isocyanate group.

A fifth embodiment of the present invention is a light-heat-conversion type image formation material comprising a heat transfer sheet and an image receiving material, wherein said heat transfer sheet comprises a light-heat-conversion layer which includes an infrared light absorbing colorant and an image formation layer, the layers being provided in that order on a support, wherein said light-heat-conversion layer further includes at least one of compounds having an acidic group.

A sixth embodiment of the present invention is a light-heat-conversion type image formation material comprising a heat transfer sheet and an image receiving material, wherein said heat transfer sheet comprises a light-heat-conversion layer which includes an infrared light absorbing colorant and an image formation layer, the layers being provided in that order on a support, in which said light-heat-conversion layer further includes at least one or more compounds selected from compounds represented by the following general formula (10) and tautomers thereof and compounds represented by the following general formula (13):

A—S—B General formula (10)

wherein, A represents an aromatic ring or heterocyclic ring which may each have a substituent; B represents a hydrogen atom, —S—A', or —C(=O)$R^1$; A' represents an aromatic ring or heterocyclic ring which may each have a substituent, and may be the same as said A; and $R^1$ represents an alkyl group which may be branched, has 1 to 18 carbon atoms, and may include a functional group, S=D General formula (13)

wherein, D represents a 5-membered or 6-membered nitrogen-containing heterocyclic or aromatic ring; said aromatic or heterocyclic ring may have a substituent, and further, the aromatic or heterocyclic ring may be condensed.

According to the present invention, decomposition of an infrared light absorbing colorant with the lapse of time when the heat transfer sheet and the light-heat-conversion type image forming material is stored or the like, can be suppressed by adding an additive to a light-heat-conversion layer.

DESCRIPTION OF THE PREFERRED EMBODIMENTS

A heat transfer sheet and a light-heat-conversion type image forming material of the present invention will be illustrated in detail below.

Heat Transfer Sheet

A heat transfer sheet of the present invention comprises a light-heat-conversion layer containing an infrared light absorbing colorant and an image formation layer, disposed in that order on a support, the light-heat-conversion layer further contains at least one compound from any one of the groups which include a) compounds having at least one functional group selected from a phosphate group, a phosphite group, an acid halide group, a sulfonic halide group, an acid anhydride group and an isocyanate group, b) compounds having an acidic group, c) compounds represented by the following general formula (10), and tautomers thereof, and compounds represented by the following general formula (13).

A—S—B General formula (10)

In the formula, A represents an aromatic ring or a heterocyclic ring which may each have a substituent; B represents a hydrogen atom, —S—A', or —C(=O)$R^1$; A' represents an aromatic ring or heterocyclic ring which may each have a substituent, and may be the same as said A; $R^1$ represents an alkyl group which may be branched, has 1 to 18 carbon atoms, and may include a functional group, S=D General formula (13)

In the formula, D represents a 5-membered or 6-membered nitrogen-containing heterocyclic or aromatic ring; said aromatic or heterocyclic ring may have a substituent, and further, the aromatic or heterocyclic ring may be condensed.

<Support>

The support used in the present invention may be any one having dimensional stability and showing heat tolerance at the time of image formation. Specific examples include: synthetic resin materials such as polyethylene terephthalate (PET), polyethylene-2,6-naphthalene, polycarbonate, polyethylene polyvinyl chloride, polyvinylidene chloride, polystyrene, styrene-acrylonitrile copolymer and the like. Of these, biaxially oriented polyethylene terephthalate is preferable in view of mechanical strength and dimensional stability with respect to heat.

When images are formed by irradiation with laser beam from the support side, it is preferable that this support is transparent. Further, when images are formed by irradiation with laser beam from the image formation layer side, it is not particularly necessary that this support is transparent.

The support may have cushioning property, to improve close adhesion with an image receiving material. In this case, materials having low elastic modulus, or materials having rubber elasticity are advantageously used. Specific examples thereof include elastomers such as natural rubber, acrylate rubber, butyl rubber, nitrile rubber, butadiene rubber, isoprene rubber, styrene-butadiene rubber, chloroprene rubber, urethane rubber, silicone rubber, acrylic rubber, fluororubber, neoprene rubber, chlorosulfonated polyethylene, epichlorohydrine, EPDM, urethane elastomer and the like, and resins having small elastic modulus among some polyethylenes, polypropylenes, polybutadienes, polybutenes, ABS resins having high impact-resistance, polyurethanes, ABS resins, acetates, cellulose acetates, amide resins, polytetrafluoroethylenes, nitrocelluloses, polystyrenes, epoxy resins, phenol-formaldehyde resins, polyesters, acrylic resins having impact resistance, styrene-butadiene copolymers, ethylene-vinyl acetate copolymers, acrylonitrile-butadiene copolymers, vinyl chloride-vinyl acetate copolymers, polyvinyl acetates, vinyl chloride resins containing a plasticizer, vinylidene chloride resins, polyvinyl chlorides, polyvinylidene chlorides and the like. The materials having low elastic modulus and materials having rubber elasticity may also be compounded in a base material of a support. Further, shape memory resins such as styrene-based hybrid polymers including polynorbornene or polybutadiene unit with a polystyrene unit may also be used.

The thickness of a support is not particularly restricted, and usually from 2 to 300 $\mu$m, and preferably from 5 to 200 $\mu$m. The thickness of a support having cushioning property is determined depending on various factors such as the kind of a resin or elastomer used, suction force at the time of close adhesion, particle size of a matting agent, amount of a matting agent used, and the like, but is usually from 10 to 100 $\mu$m.

Further, a back coat layer for imparting functions such as stability when the sheet is conveyed, heat resistance, antistatic property and the like may also be provided on the side of a support opposite to the side on which a light-heat-conversion layer is mounted. The back coat layer is formed by applying on the surface of a support a coating solution for a back coat layer prepared by dissolving a resin such as nitrocellulose and the like in a solvent or a coating solution for a back coat layer obtained by dissolving or dispersing a binder resin and fine particles of 20 to 30 $\mu$m in a solvent.

<Cushioning Layer>

A cushioning layer can be provided between a support and a light-heat-conversion layer. When dimensional stability is required, or a material having low elastic modulus is used, it is more preferable to provide a cushioning layer on a support having no cushioning property than to impart cushioning property to a support. Examples of the material of the cushioning layer, are the same as those for forming a support having cushioning property.

It is preferable that the thickness of a cushioning layer is usually from 10 to 100 $\mu$m. However, the thickness is not limited to this range, and it is preferable to appropriately determine the thickness in view of various factors such as the kind of a resin or elastomer used, suction force at the time of close adhesion, particle size of a matting agent, amount of a matting agent used, and the like.

For forming a cushioning layer, components of the cushioning layer dissolved in various solvents or dispersed in the form of latex can be applied by a coating means such as a blade coater, roll coater, bar coater, curtain coater, gravure coater and the like, or according to an extrusion lamination method and the like.

By providing a cushioning layer, close adhesion is improved, however, the time necessary for superposing the sheet and the image receiving material under vacuum conditions does not change significantly. Rather, pressure reduction which is too rapid induces generation of an air bubbles. Further, for sufficiently securing close adhesion and reducing time necessary for vacuum adhesion simultaneously, it is preferable to roughen a heat transfer sheet.

For roughening a heat transfer sheet, there are listed a method in which the surface of a cushioning layer is previously subjected to roughening treatment and then a light-heat-conversion layer and an image formation layer are provided, a method in which a matting agent is contained in the surface of a heat transfer sheet, and other methods. The extent of roughening is preferably determined depending on elasticity and film thickness of a cushioning layer, pressuring force (vacuum degree), and surface roughness of a heat transfer sheet, particle size and amount added of a matting agent.

In roughening of the surface of a cushioning layer, the surface roughness Ra is preferably in the range from 0.3 to 10 $\mu$m, though it varies depending on the material of which a cushioning layer is formed. The range is also approximately the same for roughening the surface of a heat transfer sheet.

<Light-Heat-Conversion Layer>

(Infrared Light Absorbing Colorant)

In a light-heat-conversion layer, an infrared light absorbing colorant is used as a light-heat-conversion substance. The infrared light absorbing colorants which can be used include an indolenine colorants and derivative thereof, a polymethine colorant and derivatives thereof, a phthalocyanine colorant and derivatives thereof, a naphthalocyanine colorant and derivatives thereof, a squalirium colorant and derivatives thereof, cyanine dyes, nitroso compounds and metal complex salts thereof, thiol nickel salts, a triallylmethane colorant and derivatives thereof, an immonium colorant and derivatives thereof, a naphthoquinone colorant and derivatives thereof, an anthraquinone colorant and derivatives thereof, an anthracene colorant and derivatives thereof, an azulene colorant and derivatives thereof, and the like. Specifically, the examples include groups of compounds described in Japanese Patent Application Laid-Open (JP-A) Nos. 62-87388, 63-264395, 63-319191,64-33547, 1-160683,1-280750, 1-293342,2-2064,2-2074, 3-26593, 3-30991, 3-30992, 3-34891, 3-36093, 3-36094, 3-36095, 3-42281, 3-63185, 3-97589, 3-97590, 3-97591, 3-103476, 3-124488, 3-132391, 4-140191, 4-161382, 4-169289, 4-169290, 4-173290, 4-173291, 5-32058, 5-201140, 5-221164, 5-338358, 6-24143, 6-32069, 6-115263, 6-210987, 6-255271, 6-309695, 7-101171, 7-149049, 7-172059, 7-195830, 9-58143, 9-80763, 10-207065, 10-268512, 11-95026, and 11-302610. The infrared light absorbing colorant used in the present invention are preferably those containing a methine group, and particularly, an indolenine colorant and derivatives thereof are preferable. Further, it is preferable that a light-heat-conversion layer contains two or more infrared light absorbing pigments.

(Additives)

A heat transfer sheet of the present invention may contain, as an additive in a light-heat-conversion layer,at least one of the compounds included in any one group selected from a) compounds having at least one functional group selected from a phosphate group, a phosphite group, an acid halide group, a sulfonic halide group, an acid anhydride group and an isocyanate group, b) compounds having an acidic group, c) compounds represented by the following general formula (10), and tautomers thereof, and compounds represented by the following general formula (13).

A—S—B General formula (10)

In the formula, A represents an aromatic ring or a heterocyclic ring which may have a substituent; B represents a hydrogen atom, —S—A', or —C(=O)$R^1$; A' represents an aromatic ring or heterocyclic ring which may have a substituent, and may be the same as said A; $R^1$ represents an alkyl group which may be branched, has 1 to 18 carbon atoms, and may include a functional group, S=D General formula 13

In the formula, D represents a 5-membered or 6-membered nitrogen-containing heterocyclic or aromatic ring; said aromatic or heterocyclic ring may have a substituent, and further, the aromatic or heterocyclic ring may be condensed.

A heat transfer sheet or a coating solution thereof manifests, in general, reduction in recording abilities such as reduction in sensitivity, deterioration of resolution, and the like with the lapse of time when stored and the like. Particularly, this is remarkable under conditions of high temperature and high humidity. This is believed to be derived from decomposition of an infrared light absorbing colorant contained in a light-heat-conversion layer. Further, even if a heat transfer sheet is stored at room temperature, when the storage period is long, an infrared light absorbing colorant may sometimes be decomposed by the effect of the remaining solvent and the like in the film, providing a cause of reduction in recording abilities. Further, even if a light-heat-conversion layer is stored in the form of a coating solution, an infrared light absorbing colorant may sometimes be decomposed, a desired optical density is not obtained and reduction in image quality occurs.

For preventing such reduction in recording abilities of a heat transfer sheet, it is advantageous that a light-heat-conversion layer contains an additive having a quenching effect on oxidizer, and nucleophilic species and the like which cause decomposition of an infrared light absorbing colorant. In the present invention, by inclusion of the above-mentioned compound, reduction in recording abilities (optical density) of a heat transfer sheet can be prevented, and resolution can be improved.

The compounds having at least one functional group selected from a phosphate group, a phosphite group, an acid anhydride group, an acid halide group, a sulfonic halide group and an isocyanate group, used in the present invention, have a hydrogen atom, alkyl group or aryl group. The alkyl group and aryl group may also contain other functional group or groups. Further, compounds having an acid anhydride as a functional group may have closed ring structure.

Examples of the compounds having at least one functional group selected from a phosphate group, a phosphite group, an acid anhydride group, an acid halide group, a sulfonic halide group and an isocyanate group, used in the present invention, include compounds represented by the following general formulae (1) to (6).

General formula (1)

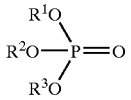

-continued

General formula (2)

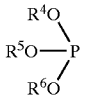

$R^7—C(=O)—O—C(=O)—R^8$ General formula (3)

$R^9COX$ General formula (4)

$R^{10}SO_2X$ General formula (5)

$R^{11}NCO$ General formula (6)

In the formula, $R^1$, $R^2$, $R^3$ $R^4$, $R^5$, $R^6$, $R^7$, $R^8$, $R^9$, $R^{10}$, and $R^{11}$ represent a hydrogen atom, an alkyl group or aryl group and said alkyl group and aryl group may include other functional group; $R^7$ and $R^8$ may be connected to have a closed ring structure; and X represents a halogen atom.

Preferable examples of the compounds having at least one functional group selected from a phosphate group, a phosphite group, an acid anhydride group, an acid halide group, a sulfonic halide group and an isocyanate group are the following compounds.

Trimethyl phosphate, triethyl phosphate, tributyl phosphate, triamyl phosphate, tri-2-ethylhexyl phosphate, tricycloethyl phosphate, triphenyl phosphate (these are phosphates), trimethyl phosphite, triethyl phosphite, tributyl phosphite, tridecyl phosphite, trilauryl phosphite, triocadecyl phosphite, triphenyl phosphite, dimethyl phosphite, diethyl phosphite, dibutyl phosphite, dipheyl phosphite (these are phosphates), maleic anhydride, succinic anhydride, glutaric anhydride, phthalic anhydride, acetic anhydride, isatoic anhydride, pyromellitic anhydride (these are acid anhydrides), acetic chloride, acetic bromide, propionic chloride, butanoic chloride, hexanoic chloride, octanoic chloride, lauric chloride, myristic chloride, palmitic chloride, stearic chloride, oleic chloride, acrylic chloride, methacrylic chloride, benzoic chloride, cinnamic chloride, phenylacetic chloride, oxalic dichloride, succinic dichloride, maleic dichloride, fumaric dichloride, phthalic dichloride, isophthalic dichloride, terephthalic dichloride, malonic dichloride, adipic dichloride, sebacic dichloride (these are acid halides), methanesulfonic dichloride, methanesulfonic chloride, p-toluenesulfonic chloride, benzenesulfonic chloride (these are sulfonic halides), n-butyl isocyanate, tert-butyl isocyanate, adamantyl isocyanate, octyl isocyanate, octadecyl isocyanate, phenyl isocyanate, cyclohexyl isocyanate, xylylene diisocyanate, toluene diisocyanate, isophorone diisocyanate, hexamethylene diisocyanate, diphenylmethane diisocyanate (these are isocyanates) and the like.

The above-mentioned compound may contain two or more these functional groups in the sama molecule. Trimellitic anhydride mono-acid chloride and the like are examples.

Further, polymer compounds having at least one functional group selected from a phosphate group, a phosphite group, an acid anhydride group, an acid halide group, a sulfonic halide group and an isocyanate group may also be used as a compound to be contained in a light-heat-conversion layer. Use of a polymer compound as an additive is preferable since then, interlayer movement does not occur easily even under high humidity. For example, polymers of one or more polymerizable monomers (a) having at least one functional group selected from a phosphate group, a phosphite group, an acid anhydride group, an acid halide group, a sulfonic halide group and an isocyanate group, or copolymers of these polymerizable monomers (a) with polymerizable monomers other than the polymerizable monomers (a) may also be permissible. Further, polymer compounds may also be permissible which are obtained by exchanging functional groups of copolymers of polymerizable monomers (b) having a functional group other than a phosphate group, a phosphite group, an acid anhydride group, an acid halide group, a sulfonic halide group and an isocyanate group and polymerizable monomers other than the polymerizable monomers (b), for functional groups selected from a phosphate group, a phosphate group, an acid anhydride group, an acid halide group, a sulfonic halide group and an isocyanate group.

Examples of the polymerizable monomers having at least one functional group selected from a phosphate group, a phosphite group, an acid anhydride group, an acid halide group, a sulfonic halide group and an isocyanate group, include maleic anhydride, (meth)acrylic chloride, styrenesulfonic chloride, (meth)acryloyloxyethyl isocyanate, (meth)acryloyl isocyanate, and compounds represented by the following general formula (7) and the like.

General formula (7)

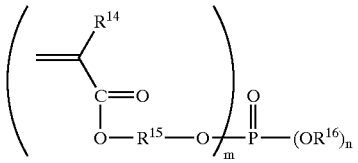

[wherein, $R^{14}$ represents a hydrogen atom or a methyl group, $R^{15}$ represents an alkylene having 2 to 6 carbon atoms, $R^{16}$ represents an alkyl group or aryl group. This alkyl group and aryl group may be substituted with a substituent. m is an integer from 1 to 3, and n is an integer from 0 to 2, providing n+m=3].

Examples of the polymer compound using these polymerizable monomers include, a styrene/maleic anhydride copolymer, methyl vinyl ether/maleic anhydride copolymer, (partial) reaction products of styrene/maleic anhydride copolymer with water, alcohol, and amines, (meth) acryloyloxyethyl isocyanate/(meth)acrylate copolymer, and the like.

The above-mentioned polymer compound may also be a polymer obtained by a polyaddition or polycondensation reaction. Examples of such a compound include polyamic acid obtained from di-acid anhydride and diamine, and the like.

The amount to be used of compounds represented by the general formulae (1) to (6) for suppressing decomposition of an infrared light absorbing colorant is preferably from 0.05 to 50 times the number of moles of the infrared light absorbing colorant. More preferably, it is in the range from 0.5 to 5 times the number of moles of the ingrared light absorbing colorant.

The compound having an acidic group used in the present invention is preferably a weak protonic acid having a carboxyl group, sulfonic group or the like. The pK of a compound having an acidic group is preferably in the range from 1 to 10. When the pK is greater than 10, the suppressing of decomposition of an infrared light absorbing colorant decreases, and when the pK is less than 1, a compound having an acidic group decomposes an infrared light absorbing colorant.

The compound having an acidic group used in the present invention may have an alkyl group or an aryl group. Further, this alkyl group or aryl group may also contain other functional group or groups.

Preferable examples of the compound having an acidic group are the following compounds:

acetic acid, propionic acid, butanoic acid, hexanoic acid, octanoic acid, lauric acid, myristic acid, palmitic acid, stearic acid, oleic acid, acrylic acid, methacrylic acid, itaconic acid, benzoic acid, cinnamic acid, phenylacetic acid, oxalic acid, succinic acid, maleic acid, glutaric acid, fumaric acid, phthalic acid, isophthalic acid, terephthalic acid, malonic acid, adipic acid, sebacic acid, trimellitic acid, pyromellitic acid, tartaric acid, methanesulfonic acid, p-toluenesulfonic acid, benzenesulfonic acid and the like.

The compound to be contained in a light-heat-conversion layer, may also be a polymer compound having an acidic group. Use of a polymer compound as an additive is preferable since then, interlayer movement does not occur easily even under conditions of high humidity. For example, polymers of at least one polymerizable monomer (a) having an acidic group, or copolymers of one of these polymerizable monomers (a) with a polymerizable monomer other than the polymerizable monomer (a) may also be used. Further, polymer compounds which are obtained by exchanging functional groups of copolymers of polymerizable monomers having no acidic group (b) and polymerizable monomers other than the polymerizable monomers (b),for acidic groups.

Examples of the polymerizable monomer having an acidic group include, (meth)acrylic acid, cinnamic acid, styrenesulfonic acid, styrenecarboxylic acid, maleic acid and the like. Examples of the polymer compound using these monomers include poly(meth)acrylic acid, (meth)acrylic acid/(meth)acrylate copolymer, and the like.

Further, polymers obtained by a polyaddition or polycondensation reaction are also permissible. Examples of such compounds include polyurethane and plyurea polymers and the like, obtained by polyaddition of a diamine or diol having an acidic group with a isocyanate.

Compounds represented by the general formula (8) or (9) can be used as a compound having an acidic group.

$R^1COOH$ General formula (8)

$R^2SO_3H$ General formula (9)

In the formulae, $R^1$ and $R^2$ represent an alkyl group or aryl group; and said alkyl group and aryl group may include other functional group or groups.

The addition amount of compounds represented by the general formula (8) or (9) for suppressing decomposition of an infrared light absorbing colorant is preferably from 0.05 to 50 times the number of moles of the infrared light absorbing colorant. More preferably, it is in the range from 0.5 to 5 times the number of moles of the infrared light absorbing colorant.

In the compound represented by the above-mentioned general formula (10) used in the present invention, A in the formula represents an aromatic ring or heterocyclic ring optionally having a substituent. Examples of the aromatic ring include a benzene ring, naphthalene ring, anthracene ring, phenanthrene ring, pyrene ring, azulene ring and the like, and of these, a benzene ring is preferable. As the above-mentioned heterocyclic ring, those containing a S atom or N atom are preferable. Further examples of the above-mentioned substituent are an alkyl group, aryl group, halogen group, hydroxyl group, amino group, ether group, thioether group, ester group, thioester group, thiol group, amide group, thioamid group, alkyl groups having a substituent and the like. Of these, an alkyl group, aryl group, hydroxyl group, thiol group, ether group, thioether group are preferable.

Specific examples of the above-mentioned A include, but are not limited to, the following (I-1) to (I-17).

(I-1)

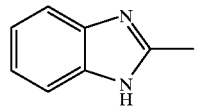

(I-2)

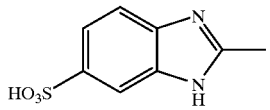

(I-3)

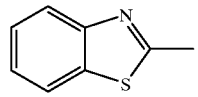

(I-4)

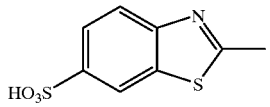

(I-5)

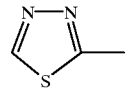

(I-6)

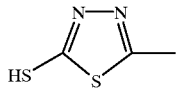

(I-7)

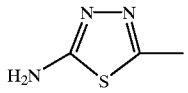

(I-8)

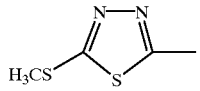

(I-9)

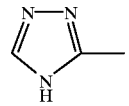

(I-10)

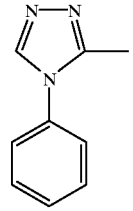

-continued (I-11)

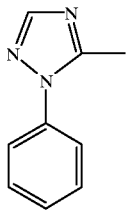

(I-12)

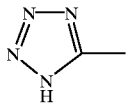

(I-13)

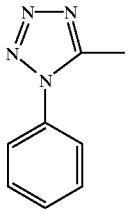

(I-14)

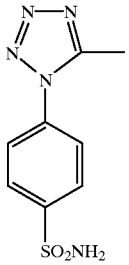

(I-15)

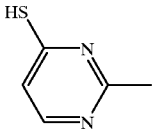

(I-16)

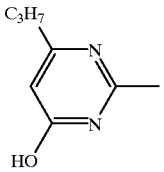

(I-17)

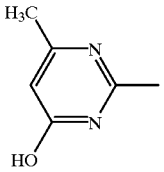

In the compound represented by the above-mentioned general formula (10) used in the present invention, B in the formula represents a hydrogen atom, —S—A', or —C(=O)$R^1$. A' represents an aromatic ring or heterocyclic ring optionally having a substituent. The aromatic ring or heterocyclic ring may be the same rings as those listed as examles for A. A' and A may be the same.

$R^1$ represents an alkyl group which may be branched having 1 to 18 carbon atoms. Of these, alkyl groups having 1 to 4 carbon atoms are preferable. When the carbon number is over 18, the effect of suppressing decomposition of an infrared light absorbing colorant decreases. Further, $R^1$ may have a functional group, which may be, a hydroxyl group, ether group, ester group, carbonate group and the like.

In the general formula (10), B is preferably a hydrogen atom, or —S—A' in which A' is the same as A shown in the general formula (10).

In the general formula (10), —S—B is selected from a thiol, a thioester having a protective group introduced by an ester, or a dimer structure comprised of thiols linked by a disulfide bond.

Specific examples of the thioester include acetates, trifluoroacetates, pivalates, propionates, 2-ethylhexanoates, decanoates, laurates, stearates and the like. The present invention is not limited to these.

The compound represented by the general formula (10) is preferably a compound represented by the following general formula (11) or the general formula (12).

General formula (11)

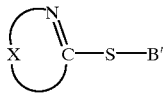

General formula (12)

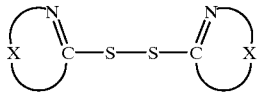

In the above-mentioned general formulae (11) and (12), X each independently represents an atomic group forming a 5-membered or 6-membered nitrogen-containing heterocyclic ring, and in the general formula (12), atomic groups represented by X may be the same or different. In the nitrogen-containing heterocyclic ring, an aromatic ring and a heterocyclic ring may also be condensed. The aromatic ring and heterocyclic ring may be the same rings as those listed as examples for A. Further, the aromatic ring and heterocyclic ring may have a substituent, and as the substituent, the same groups as described above are listed.

In the general formula (11), B' represents a hydrogen atom or —C(=O)$R^2$. $R^2$ represents an alkyl group which may be branched having 1 to 18 carbon atoms. Of these, alkyl groups having 1 to 4 carbon atoms are preferable. When the number of carbon atoms is over 18, the effect of suppressing decomposition of an infrared light absorbing colorant is decreased. Further, the above-mentioned $R^2$ may have a functional group, and as this functional group, a hydroxyl group, ether group, ester group, carbonate group and the like are listed.

Specific examples (II-1) to (II-26) of compounds represented by the general formulae (10) to (12) are listed below, but the present invention is not limited to these.

(II-1)

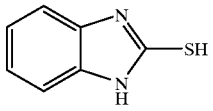

-continued
(II-2)
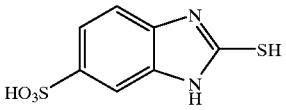
(II-3)
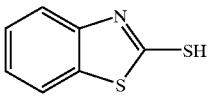
(II-4)
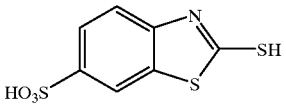
(II-5)
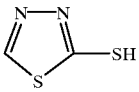
(II-6)
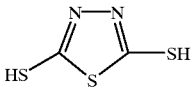
(II-7)
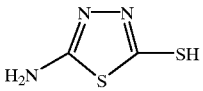
(II-8)
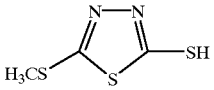
(II-9)
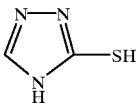
(II-10)
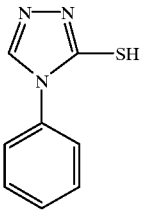
(II-11)
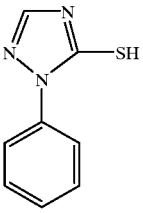
(II-12)
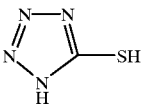
-continued
(II-13)
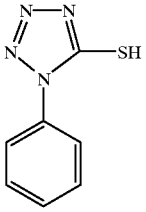
(II-14)
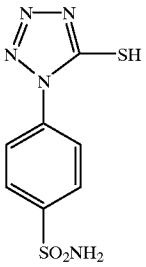
(II-15)
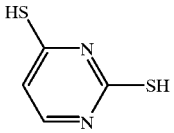
(II-16)
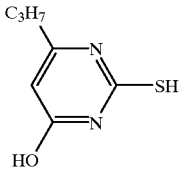
(II-17)
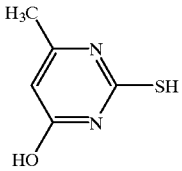
(II-18)
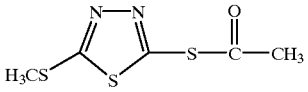
(II-19)
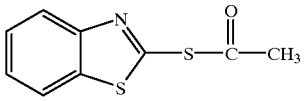
(II-20)
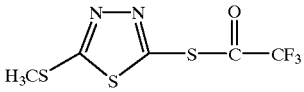
(II-21)
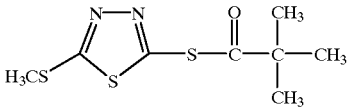

-continued (II-22)

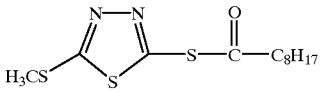

(II-23)

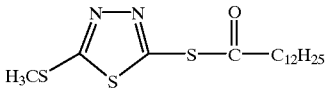

(II-24)

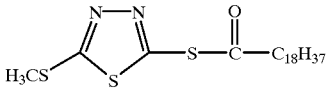

(II-25)

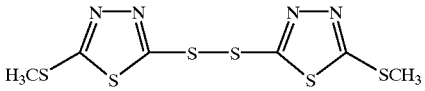

(II-26)

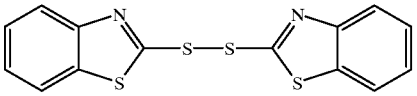

[Tautomer]

In addition to compounds represented by the general formula (10), the compounds to be contained in a light-heat-conversion layer of the present invention may also include tautomers having a relationship described below with a compound represented by the general formula (10).

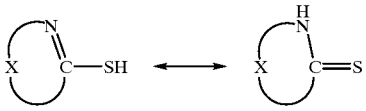

Specific examples (III-1) to (III-7) of compounds having a tautomeric relationship with a compound represented by the above-mentioned general formulae (10) to (12) are listed below, but the present invention is not limited to these compounds.

(III-1)

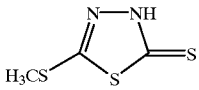

(III-2)

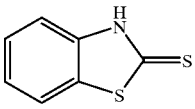

(III-3)

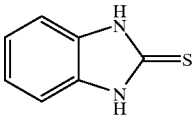

-continued (III-4)

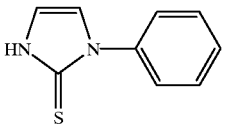

(III-5)

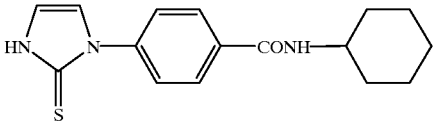

(III-6)

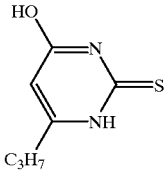

(III-7)

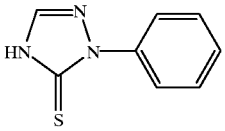

In the compound represented by the above-mentioned general formula (13) used in the present invention, D in the formula represents a 5-membered or 6-membered nitrogen-containing heterocyclic ring or aromatic ring. The aromatic ring and heterocyclic ring may have a substituent, and as the substituent, the same groups as described above are listed. Further, as the above-mentioned heterocyclic ring, those containing an S atom or N atom are preferable. Further, as the above-mentioned substituent, the same substituents as described above are listed.

In the above-mentioned aromatic ring and heterocyclic ring, the aromatic ring or heterocyclic ring may also be condensed, further.

As the compound represented by the general formula (13), compounds having a tautomeric relationship with a compound represented by the general formulae (10) are also included. Specific examples of the compound represented by the general formula (13) are listed below, but the present invention is not limited to these.

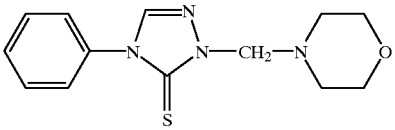

The amount of a compound represented by the general formula (10) or (13) to be added to a light-heat-conversion layer is preferably from 0.1 to 10 mol for each mol of an infrared light absorbing colorant contained in a light-heat-conversion layer. It is more preferably from 0.5 to 5 mol, and an amount from 1 to 2 mol for each mol of an infrared light absorbing colorant is particularly preferable. When the amount of an additive represented by the general formula (10) or (13) is over 10 mol for each mol of an infrared light absorbing colorant contained in a light-heat-conversion layer, there is a possibility that side actions such as bleeding of the additive onto the surface layer, and the like may occur, decreasing abilities of a heat transfer sheet. On the other hand, when the above-mentioned addition amount is less than 0.1 mol, the effect of the present invention can not be sufficiently achieved.

(Binder)

As the binder used in a light-heat-conversion layer, resins having a high glass transition temperature and high heat conductivity, for example, general heat-resistant resins such as polymethyl methacrylate, polycarbonate, polystyrene, ethylcellulose, nitrocellulose, polyvinyl alcohol, polyvinyl chloride, amide-based resins, polyimide, poyetherimide, polysulfone, polyether sulfone, aramide and the like, can be used. Among them, polyvinyl alcohol is particularly preferable since it does not easily cause scattering of a light-heat-conversion layer. Further, a polyimide resin is particularly preferable from the standpoint of heat-resistance.

The film thickness of a light-heat-conversion layer is preferably from 0.1 to 3 $\mu$m. The optical density of a light-heat-conversion layer at wavelengths from 800 to 830 nm is required to be from 0.3 to 2.0. When the optical density is less than 0.3, irradiated light cannot be converted into heat, and when over 2.0, a light-heat-conversion layer is decomposed at the time of recording, thereby causing fogging.

<Image Formation Layer>

In a heat transfer sheet of the present invention, an image formation layer is provided on a light-heat-conversion layer or a peel layer described below. In the present invention, the image formation layer means a layer which is transferred to an image receiving material by ablation or heat melting at the time of heating. The image formation layer contains a pigment, and an amorphous organic polymer compound. It is not necessary for this image formation layer to be transferred in a completely melted state.

(Coloring Material)

The coloring material to be contained in an image formation layer include pigments and dyes. Pigments are generally classified roughly into an organic pigments and an inorganic pigments, and the former is excellent particularly in transparency of a coated film, and the latter is generally excellent in masking property. Examples of the inorganic pigment include titanium dioxide, carbon black, zinc oxide, Prussian blue, cadmium sulfide, iron oxide, and chromates of lead, zinc, barium and calcium, and the like. Examples of the organic pigment include azo-based pigments, thioindigo-based pigments, anthraquinone-based pigments, anthanthrone-based pigments, triphenedioxazine-based pigment, bat dye pigments, isoindolinone-based pigments, nitro-based pigments, phthalocyanine-based pigments, for example, copper phthalocyanine and derivatives thereof, and quinacridone-based pigments and the like.

The content of pigments in an image formation layer is preferably from 20 to 80% by weight.

Further, a dye may also be used as the coloring material. The organic dyes include acidic dyes, direct dyes, dispersed dyes, oil-soluble dyes, metal-containing oil-soluble dyes and heat sublimation colorants. Examples of this heat sublimation colorant include cyan colorants, magenta colorants and yellow colorants.

Examples of the above-mentioned cyan colorant are naphthquinone-based colorants, anthraquinone-based colorants, azomethine-based colorants and the like described in JP-A Nos. 59-78896, 59-227948, 60-24966, 60-53563, 60-130735, 60-131292, 60-239289, 61-19396, 61-22993, 61-31292, 61-31467, 61-35994, 61-49893, 61-148269, 62-191191, 63-91288, 63-91287, 63-290793, and the like.

Examples of the magenta colorant are anthraquinone-based colorants, azo-based colorants, azomethine-based colorants and the like described in JP-A Nos. 59-78896, 60-30392, 60-30394, 60-253595, 61-262190, 63-5992, 63-205288, 64-159, 64-63194, and the like.

Examples of the yellow colorant are methine-based colorants, azo-based colorants, quinophthalone-based colorants, anthraisothiazole-based colorants and the like described in JP-A Nos. 59-78896, 60-27594, 60-31560, 60-53565, 61-12394, 63-122594, and the like.

The heat sublimation colorants are preferably azomethine colorants obtained by a coupling reaction of compounds having a open chain type or closed chain type active methylene group with an oxidized p-phenylenediamine derivative or an oxidized a p-aminophenol derivative, and indoaniline colorants obtained by a coupling reaction with phenol or naphthol derivative, an oxidezed p-phenylenediamine derivative or an oxidized a p-aminophenol derivative.

The heat sublimation colorant to be contained in an image formation layer may be any of yellow colorants, magenta colorants and cyan colorants, providing an image formed has a single color.

The content of a coloring material in an image formation layer is usually in the range from 5 to 70% by weight, and preferably in the range from 30 to 70% by weight.

(Binding Agent)

As the binding agents which can be used in an image formation layer of the present invention, substances which melt when heated, substances which soften when heated and thermoplastic resins are listed. The substance which melts when heated is usually a solid or semi-solid substance having melting temperatures in the range from 40 to 150° C. measured by using Yanagimoto MJP-2 type apparatus.

Specific examples of the substance which melts when heated include waxes like vegetable wax such as carnauba wax, haze wax, auricury wax, espar wax and the like; animal wax such as beeswax, insect wax, shellac wax, spermaceti and the like; petroleum wax such as paraffin wax, microcrystalline wax, polyethylene wax, ester wax and acid wax and the like; and mineral wax such as montan wax, ozokerite, ceresin and the like, and in addition to these waxes; higher fatty acids such as palmitic acid, stearic acid, margaric acid, behenic acid and the like; higher alcohols such as palmityl alcohol, stearyl alcohol, behenyl alcohol, marganyl alcohol, myricyl alcohol, eicosanol and the like; higher fatty esters such as cetyl palmitate, myricyl palmitate, cetyl stearate, myricyl stearate and the like; amides such as acetamide, propionic amide, palmitic amide, stearic amide, amid wax and the like; and higher amines such as stearylamine, behenylamine, palmitylamine and the like, and these may be used alone or in combination.

Specific examples of the substance which soften when heated include, waxes such as vegetable wax, animal wax, petroleum wax, mineral wax and the like. Further, in addition to these waxes, higher fatty acids, higher alcohols, higher fatty esters, amides and higher amines and the like are listed.

(Amorphous Organic Polymer)

Further, amorphous organic polymers having softening temperatures from 40 to 150° C. are also preferable. As such amorphous organic polymers, for example, a polyviylbutyral resin, butyral resin, polyamide resin, polyethyleneimine resin, sulfonamide resin, polyester polyol resin, petroleum resin, homopolymers and copolymers of styrene, derivatives thereof and substituted materials thereof such as styrene, vinyltoluene, $\alpha$-methylstyrene, 2-methylstyrene, chlorostyrene, vinylbenzoic acid, sodium vinylbenzensulfonate, aminostyrene and the like, homopolymers or copolymers with other monomers of vinyl-based monomers such as methacrylates such as methyl methacryalte, ethyl methacrylate, butyl methacrylate, hydroxyethyl methacryalte and the like and methacrylic acid, acrylates such as methyl acrylate, ethyl acrylate, butyl acrylate, α-ethylhexyl acrylate and the like and acrylic acid, dienes such as butadiene, isoprene and the like, acrylonitrile, vinyl ethers, maleic acid and maleates, maleic anhydride, cinnamic acid, vinyl chloride, vinyl acetate and the like, can be used. These resins can be used in admixture of two or more.

The thermoplastic resin includes polymer compounds having softening temperatures from 50 to 150° C. and the like. These include resins such as an ethylene copolymer, polyamide resins, polyester resin, polyurethane resin, polyolefin resin, acrylic resin, vinyl chloride resin, cellulose resin, rosin resin, ionomer resin and petroleum resin and the like; elastomers such as natural rubber, styrene-butadiene rubber, isoprene rubber, chloroprene rubber and the like; rosin derivatives such as ester gum, rosin-maleic acid resin, rosin-phenol resin, hydrogenated rosin and the like; phenol resins, terpene resins, cyclopentadiene resins, aromatic hydrocarbon resins and the like.

Among these binding agents, amorphous organic polymers having softening temperatures from 40 to 150° C. are preferably used. The content of the amorphous organic polymer in an image formation layer is from 20 to 80% by weight, preferably from 30 to 70% by weight, particularly preferably from 40 to 60% by weight.

The image formation layer may further contain surfactants, inorganic or organic fine particles (metal powder, silica gel and the like), oils (linseed oil, mineral oil and the like) and the like, in addition to the above-mentioned components. Excepting the case of obtaining black images, energy required for transfer can be reduced by inclusion of a substance which absorbs the wavelength of a light source used in image recording. As the substance which absorbs the wavelength of a light source, any of pigments and dyes may be used, however, in the case of obtaining color images, it is preferable from the standpoint of color reproduction that a dye manifesting little absorption in visible portions and large absorption of the wavelength of a light source is used in image recording by using a light source of infrared ray such as semi-conductor laser and the like. Examples of a near infrared dye include compounds described in JP-A No. 3-103476.

(Matting Agent)

A matting agent can be added to an image formation layer. When a support has cushioning property, or when a cushion layer which has not been roughened is provided on a support, it is preferable to add a matting agent to the image formation layer, for roughening of the surface. Examples of the matting agent are inorganic fine particles and organic fine particles. Examples of this inorganic fine particle include particles of metal salts such as silica, titanium oxide, aluminum oxide, zinc oxide, magnesium oxide, barium sulfate, magnesium sulfate, aluminum hydroxide, magnesium hydroxide, boron nitride and the like, kaolin, clay, talc, zinc white, white lead, sieglite, quartz, diatomaceous earth, pearlite, bentonite, mica, synthetic mica, and the like. Examples of the organic fine particle include resin particles such as a fluoroplastic particle, guanamine resin particle, acrylic resin particle, styrene-acrylic copolymer resin particle, silicone resin particle, melamine resin particle, epoxy resin particle and the like.

If a matting agent which is broken by pressure when a heat transfer sheet and an image receiving material are laminated and pressed or heat-pressed in transferring images is contained in a heat transfer sheet, a cushioning effect can be obtained even if a cushion layer is not provided on, or cushioning property is not imparted to a support.

Examples of the matting agent which is broken when pressure is applied include fine particles made of materials having rubber elasticity. Specific examples inlude elastomers such as acrylate rubber, butyl rubber, nitrile rubber, butadiene rubber, isoprene rubber, styrene-butadiene rubber, chloroprene rubber, urethane rubber, silicone rubber, acrylic rubber, fluororubber, neoprene rubber, chlorosulfonated polyethylene, epichlorohydrine, EPDM, and the like. Examples of the matting agent which is broken by pressing with heat, fine particles composed of wax having low hardness such as paraffin wax, beeswax, wax having significant oil content, wax containing lower molecular components in considerable amount, and the like, can be used. A heat transfer sheet roughened by this wax fine particles can be produced at a temperature lower than the melt initiation temperature of wax which forms fine particles, by 10° C. or more.

The particle size of the matting agent is usually from 0.3 to 30 μm, preferably from 0.5 to 20 μm, and the addition amount thereof is from 0.1 to 100 mg/m$^2$.

The thickness of an image formation layer is usually in the range from 0.1 to 3 μm, and preferably in the range from 0.2 to 1.0 μm.

(Scatter Prevention Layer)

If high intensity energy such as laser beam and the like is used as light source, a scatter prevention layer may be provided to prevent scattering of a light-heat-conversion substance or a binder due to heat generated when the above-mentioned light-heat-conversion layer rapidly absorbs light energy. The scatter prevention layer is preferably composed of a material having sufficient strength to suppress scattering of a light-heat-conversion layer, with a thin film, and having high heat conductivity to enable heat generated in a light-heat-conversion layer to be transferred quickly to an image formation layer. The scatter prevention layer is formed of general heat-resistant resins etc. such as those used as the binder in a light-heat-conversion layer. However, of these polyvinyl alcohol is preferable since it has large scatter preventing effect, it can be dissolved in water and then applied, and mixing with an image formation layer or light-heat-conversion layer is small.

When irradiation with light is effected from the support side of a heat transfer sheet, a scatter prevention layer may also be opaque, and a metal deposited film such as aluminum and the like also have a scatter preventing effect. When the film thickness of a scatter prevention layer is smaller, sensitivity is higher, and when the thickness is large, a scatter preventing effect is higher, and generally, the thickness is from 0.05 to 1.0 μm.

(Peel Layer)

A peel layer can be provided between a light-heat-conversion layer and an image formation layer. Owing to the presence of a peel layer, peeling of an image formation layer at the time of heat-sensitive transfer recording becomes easy, and image of high quality can be obtained. Though the peel layer can be composed of a compound which melts when heated, it is usually preferable that the peel layer is composed of a binder resin and the like such as a compound which melts when heated and/or thermoplastic resin and the like.

The compound which melts when heated used as the main component of the peel layer may be appropriately selected from known compounds. Specific examples thereof include those in JP-A No. 63-193886, p. 4, upper left column, line 8 to upper right column, line 12. Specific examples of the thermoplastic resin include ethylene copolymers such as an ethylene-vinyl acetate resin and the like, polyamide resins, polyester resins, polyurethane resins, polyolefine resins, acrylic resins and cellulose resins and the like. In addition, for example, resins such as vinyl chloride resins, rosin resins, petroleum resins, ionomer resins and the like, elastomers such as natural rubber, styrene-butadiene rubber, isoprene rubber, chloroprene rubber and the like, ester gum, rosin-derivatives such as rosin-maleic acid resins, rosin-phenol resins and hydrogenated rosins and the like, and phenol resins, terpene resins, cyclopentadiene resins and aromatic resins and the like can also be used depending on the case.

In the present invention, of the thermoplastic resin which can be used as a component of a peel layer, those having melting temperatures or softening temperatures usually in the range from 50 to 150° C., particularly in the range from 60 to 120° C., or those which obtain such a range by two or more of them being mixed, are suitably used.

<Production of Heat Transfer Sheet>

For production of a heat transfer sheet of the present invention, the above-mentioned components forming respective layers are first mixed while being heated, or dispersed or dissolved the components in a solvent, to prepare coating solutions for forming respective layers. These coating solutions are applied sequentially on the surface of a support, and if necessary, a solvent is removed, to obtain the desired heat transfer sheet.

The solvent for preparing a coating solution include water, alcohols (e.g., ethanol, or methanol), cellosolves (e.g., methylcellosolve, or ethylcellosolve), aromatics (e.g., toluene, xylene, or chlorobenzene), ketones (e.g., acetone, or methyl ethyl ketone), ester solvents (e.g., ethyl acetate, or butyl acetate), ethers (e.g., tetrahydrofuran, or dioxane), chlorine-containing solvents (e.g., chloroform, or trichloroethylene) and the like.

The coating method may be a conventionally known gravure roll coating method, extrusion coating method, wire bar coating method, roll coating method and the like.

The image formation layer may be formed as a layer containing coloring materials of a single color in the whole surface or parts of the surface of a support. Alternatively, yellow image formation layers containing a binder and a yellow colorant, magenta image formation layers containing a binder and a magenta colorant, and cyan image formation layers containing a binder and a cyan colorant may be repeatedly formed on the whole surface or parts of the surface of a support along the plane direction. Further, these image formation layers having the respective colors may also be laminated.

Use of a heat transfer sheet, can be facilitated by forming perforations or providing detection marks for detecting positions of regions of different hues.

Light-Heat-Conversion Type Image Formation Material

A light-heat-conversion material of the present invention is composed of the above-mentioned heat transfer sheet of the present invention and image receiving materials (including an image receiving material used as an intermediate transfer body).

<Image Receiving Material>

The image receiving material indicates an image recording medium which receives an image formation layer which has been peeled image-wise from a heat transfer sheet, to thereby form images. This image receiving material usually has a support and an image receiving layer, however, it may be formed only of a support in some cases.

The image receiving material is not particularly restricted providing it can be applied to a heat transfer sheet of the present invention, however, it is desirable that it has appropriate heat-resistance since an image formation layer melted by heat is transferred to the image receiving material and that it has excellent dimensional stability so that images are formed appropriately.

<Support>

Examples support of an image receiving material include resin films or resin sheets and the like made of polyethylene, polypropylene, polyethylene terephthalate, polystyrene, polyvinyl chloride, polyimide and the like when images are seen through the support from the surface opposite that having the transferred images. Further, when images are not seen through the support from the surface opposite that having the transferred images, but are seen from the surface on which transferred images (reflection image) are formed, white films formed by adding a white pigment such as barium sulfate, calcium carbonate, titanium oxide and the like to a resin film or a resin sheet, and papers such as coated paper, art paper, RC paper and the like, etc., can be used as the support. The thickness of the support of an image receiving material is usually from 10 to 400 $\mu$m, preferably from 25 to 200 $\mu$m. Further, the support is preferable a white material containing air spaces such as air bubbles and the like from the standpoint of cushioning property, visibility of images and the like. Particularly, a foamed polyester support such as white polyethylene terephthalate and the like is most preferable from the standpoint of mechanical properties. The surface of a support may also be subjected to surface treatments such as a corona discharge treatment, glow discharge treatment and the like in order to increase adhesion with the image receiving layer.

In order to impart cushioning properties to the support, the support may be formed of the above mentioned materials which impart cushioning properties. It may also be formed of a composite film or composite sheet formed by combining the resin film or the resin sheet with a film or sheet formed from the material which imparts cushioning properties.

The support is formed of a binder and various additives as necessary. When the support does not have cushioning property, the above-mentioned material for imparting cushioning property may also be added to an image receiving layer.

<Image Receiving Layer>

The image receiving layer is a layer formed mainly of an organic polymer binder. The binder is preferably a thermoplastic resin, example of which include: homopolymers and copolymers of acrylic monomers such as acrylic acid, methacrylic acid, acrylate, methacrylate and the like; cellulose polymers such as methylcellulose, ethylcellulose, cellulose acetate and the like; homopolymers and copolymers of vinyl-based monomers such as polystyrene, polyvinylpyrrolidone, polyvinylbutyral, polyvinyl alcohol, polyvinyl chloride and the like; condensed type polymers such as polyester, polyamide and the like; rubber polymers such as a butadiene-styrene copolymer. The binder in an image receiving layer is preferably a polymer having a glass transition temperature (Tg) lower than 90° C., in order to obtain appropriate adhesive force between the image receiving layer and an image formation layer. It is also possible to add a plasticizer to the image receiving layer in order obtain an appropriate adhesive force. Further, the binder polymer in the image receiving layer preferably has a Tg of 30° C. or more, in order to prevent blocking between sheets. It is particularly preferable that the binder polymer in the image receiving layer is the same polymer as the binder polymer in an image formation layer or one similar to it in order to improve adhesion with the image formation layer in laser recording, and to improve sensitivity and image strength.

The thickness of the image receiving layer is from 0.3 to 7 μm, preferably from 0.7 to 4 μm. When it is 0.3 μm or less, film strength at the time of re-transfer to printing paper is deficient, easily leading to breakage. When it is too thick, gloss of images after re-transfer to paper increases, and likeness of transferred image to the printed product lowers.

<Cushioning Layer>

In an image receiving material of the present invention, it is preferable to provide a cushioning layer between a support and an image receiving layer instead of imparting cushioning property to the support or image receiving layer. In this case, detailed descriptions of the cushioning layer will be omitted since this is the same as the above-mentioned cushioning layer in a heat transfer sheet. The thickness of a support in an image receiving material containing a support, cushioning layer and image receiving layer, or the thickness of a support in an image receiving material formed only of a support, is not particularly restricted. The thickness of the cushioning layer is the same as the thickness of the cushioning layer in a heat transfer sheet. The thickness of an image receiving layer is usually from 0.1 to 20 μm, however, this is not the case when a cushioning layer is used as an image receiving layer.

The surface of an image receiving material which will be in contact with a heat transfer sheet in forming images may have excellent smoothness, or may have been roughened appropriately. Further, when the surface of an image formation layer of a heat transfer sheet is roughened by addition of the above-mentioned matting agent or by roughening of a cushioning layer, it is preferable that this surface of an image receiving material which will contact a heat transfer sheet has excellent smoothness. On the other hand, when an image formation layer is not roughened, it is preferable that the surface of the image receiving material which will contact an image formation layer is roughened by addition of the above-mentioned matting agent or by roughening of a cushioning layer. Further, both of an image formation layer, and the surface of an image receiving material which contact the image formation layer may also be roughened. In the case where the both the heat transfer sheet and the image receiving material have not been roughened, it is preferable that the image receiving material having a cushioning layer is subjected to a roughening process immediately before the heat transfer sheet and the image receiving material are closely adhered to each other, and then when they are in a state of being closely adhered due to a vacuum, the roughened parts are made smooth once again.

<Matting Agent>

The matting agent used for the image receiving layer are the same as for the heat transfer sheet. Therefore, the detailed descriptions are omitted. By using a matting agent which breaks due to pressure or due to a combination of heat and pressure, it is not necessary to use a material or an image receiving layer having cushioning properties for the image receiving material, nor is it necessary to provide a cushioning layer. This is the same as the case for the matting agent of the heat transfer sheet.

By using a matting agent in a heat transfer sheet or an image receiving material, and suitably roughening a contact surface between a heat transfer sheet and an image receiving material, the disadvantage of excessively close adhesion of the surfaces to each other can be eliminated. On the other hand, disadvantages caused by use of a matting agent, namely, generation of unevenness at the time of close adhesion, reduction in resolution, color turbidity and the like can be eliminated by imparting cushioning property to the image receiving material.

The above-described image receiving material can be utilized as a final image recording material when images are transferred and formed by a heat transfer sheet.

When a plurality of heat transfer sheets having colorants with different colors from each other, and one image receiving material are used, and an image formation layer having single color is transferred image-wise by respective heat transfer sheet to the image receiving material to form multi-color of full color transferred images, then, it is necessary that the image receiving material has cushioning property. Particularly, it is preferable to form a support having cushioning property or a cushioning layer with a recoverable shape memory resin.

<Image Receiving Material Used as an Intermediate Transfer Body>

In general, when an image formation layer is heat-transferred image-wise by a heat transfer sheet to an image receiving material, it is preferable that the surface of an image receiving material is smooth in order to obtain transferred images having high image quality. In other words, with an image receiving material having low surface smoothness, images having high quality cannot be recorded.

For forming images of high quality on an image receiving material having low surface smoothness, it is preferable to first transfer images to an image receiving material used as an intermediate transfer body having high surface smoothness by a heat transfer sheet, then, to re-transfer images to an image receiving material having low surface smoothness.

This image receiving material used as an intermediate transfer body can have the same composition as that of the final image receiving material. However, it is necessary that an image receiving material used as an intermediate transfer body has cushioning property. Further, an image receiving material used as an intermediate transfer body is not required to be roughened. When an image receiving material used as an intermediate transfer body has a cushioning layer, the thickness thereof is preferably at least 20 μm or more since when high quality paper, for example, is used, it usually has a swell of 10 to 20 μm.

It is desired that an image receiving material which is used as an intermediate transfer body has excellent ability to receive an image formation layer and has excellent re-transfer property to the final image receiving material. Examples of the image receiving material used as an intermediate transfer body and has the desired propertie include polyethylene, polypropylene, ethylene-vinyl acetate copolymer of low VA type, ethylene-ethyl acrylate copolymer (EEA), ethylene-methacrylate copolymer (EMA), ethylene-methyl methacrylate copolymer (EMMA), ethylene-vinyl acetate copolymer, ionomer resin, chlorinated ethylene, chlorinated polypropylene, chlorinated polyolefin, butadiene rubber, isoprene rubber, SBR, SBS, SIP, polyvinylbutyral, polyvinyl acetal, polyvinyl ether, polyvinyl alcohol, polyvinyl pyrrolidone, olefin polymers such as various acrylic resins and the like, polyester resin, polyurethane resin, polyamide resin, celluloses such as nitrocellulose, cellulose acetate, ethylcellulose and the like, fluoroplastic, silicone resin and the like.

An image receiving material used as an intermediate transfer body is laminated with the final image receiving material, and pressurized or heat-pressurized to re-transfer images of the image receiving material used as an intermediate transfer body to the surface of the final image receiving material. When monochrome images are re-transferred, one image receiving material which is an intermediate transfer body and one final image receiving material are used. When multi-color re-transfer images or full-color re-transfer images are transferred to the final image receiving material, a plurality of image receiving materials which are intermediate transfer bodies may be used for one final image receiving material, or, multi-color or full-color transfer images may be transferred and formed on one image receiving material used as an intermediate transfer body, which is then re-transferred to the final image receiving material.

Both when monochrome images are re-transferred and when multi-color images or full-color images are re-transferred, any of a method to re-transfer the whole image receiving layer of an image receiving material used as an intermediate transfer body to the final image receiving material, and a method to re-transfer transferred images on an image receiving material used as an intermediate transfer body without transferring the image receiving layer, can be used.

When images only are re-transferred without re-transferring an image receiving layer, it is preferable that the image receiving layer of an image receiving material used as an intermediate transfer body does not adhere to the final image receiving material.

Further, when re-transferring is effected while heating, it is desired that the image receiving layer of an image receiving material used as an intermediate transfer body does not have heat sealing properties at the time of re-transferring. When the method is such that re-transfer is carried out while the image receiving material is being heated, it is necessary to provide a means for preventing the image receiving layer and the cushioning layer which are on the image receiving material used as an intermediate transfer body from being stripped off due to heat. An examples of such a means is providing an adhesive layer between the image receiving layer and the cushioning layer.

When image are re-transferred together with the image receiving layer of an image receiving material used as an intermediate transfer body, it is preferable that unlike the above-described case a peelable layer is intercalated between the image receiving layer and cushioning layer.

An image receiving material comprising a cushioning layer and an image receiving layer on a support and an image receiving material used as an intermediate transfer body can be obtained by mixing the above-mentioned components for forming the respective layers while heating, or else by dispersing or dissolving the components in a solvent to prepare coating solutions for forming the layers, then, applying the coating solutions on a support, if necessary removing the solvent and then repeating the process for applying and drying the solution.

Examples of the solvent used for application of coating solutions for forming the layers include water, alcohols (e.g., ethanol, or propanol, etc.), cellosolves (e.g., methylcellosolve, or ethylcellosolve, etc.), aromatics (e.g., toluene, xylene, or chlorobenzene, etc.), ketones (e.g., acetone, or methyl ethyl ketone, etc.), ester solvents (e.g., ethyl acetate, or butyl acetate, etc.), ethers (e.g., tetrahydrofuran, or dioxane, etc.), chlorine-containing solvents (e.g., methylene chloride, chloroform, or trichloroethylene, etc.) and the like.

For application of coating solutions for forming various layers, conventionally known gravure roll coating method, extrusion coating method, wire bar coating method, roll coating method and the like can be adopted. In addition to the above-mentioned coating methods, an image receiving layer can be formed by a hot melt extrusion-lamination method and the like in which a mixture containing components for forming an image receiving layer is melt-extruded and laminated.

Lamination by a hot melt extrusion-laminate method can be effected by usual methods described in JP-A Nos. 1-263081, 1-271289, 2-106397, 2-111586, 2-305688, 3-49991 and the like.

Image Formation

<Monochrome Image>

A heat transfer recording method to form a monochrome image using a heat transfer sheet of the present invention is conducted as follows. First, a heat transfer sheet and an image receiving material are superposed on a substrate. In this case, either of the heat transfer sheet or an image receiving material may be placed first on a substrate.

As the substrate, any of a cylindrical drum and a flat substrate can be used. Preferable is a cylindrical drum. When a cylindrical drum is used as a substrate, transferred images can be formed at higher speed by high-speed rotation. Further, by decreasing the space for a light irradiation system and by simplifing the optical system, energy efficiency when laser light and the like is used can be enhanced. Thus the apparatus can also be made more compact.

At the time of this operation, a heat transfer sheet and/or an image receiving material are brought into close contact with to a substrate. The means for bringing a heat transfer sheet or image receiving material in close contact with a substrate are not particularly restricted, and an example is providing a plurality of penetration holes in a substrate, and effecting exhaustion through the penetration holes using an exhaustion means, to thereby fix a heat transfer sheet or an image receiving material on the substrate by a suction force caused by the exhaustion.

In order to improve an adhesion property between the image receiving material and a substrate, if necessary, a cover sheet can be covered over a light-heat-conversion type image formation material which is a laminate of a heat transfer sheet and an image receiving material, or the size of an outer sheet can be made larger slightly than the size of an inner sheet.

A method for closely adhering and for separating two sheets, is disclosed in Japanese Utility Model Application Laid-Open No. 63-87031.

For decreasing the time it takes to closely adhere the sheets to the substrate, it is preferable to apply pressure reduction while squeezing a heat transfer sheet and an image receiving material. Further, if at least one of a heat transfer sheet and an image receiving material has a cushioning layer, when the heat transfer sheet or the image receiving material is closely adhered by first forcefully applying reduced pressure, the degree of vacuum necessary for maintaining the close-adhesion thereafter may be reduced. Therefore, if vacuum degree is once raised to a high enough level at the time of close adhesion, a high degree of vacuum is not required at the time of recording and this is advantageous in terms of the design of the apparatus.

The degree of vacuum necessary for close-adhesion by vacuum suction is from 13.3 to $4.67\times10^4$ Pa though it varies depending on the extent to which the surfaces of a heat transfer sheet and image receiving material has been roughened, and after completion of close-adhesion, it may be lower. The pressurizing force when a light-heat-conversion type image formation material into which a matting agent is compounded is pressurized, is usually from 0.1 to 5 kg/cm$^2$. When a matting agent having small particle size is used, the pressurizing force may be small, while when a matting agent having larger particle size is used, it is necessary to increase pressurizing force.

After closely adhering a light-heat-conversion type image formation material to a substrate, irradiation with light, for example, laser beam is effected image-wise from the rear side of a support if the support is transparent or from the cover sheet side. A laser beam is converted into heat by an infrared light absorbing colorant in a heat transfer sheet then an image formation layer is melted image-wise and adhered to an image receiving material. If, thereafter, the heat transfer sheet is stripped from the image receiving material, an image receiving material on which monochrome images are adhered image-wise can be obtained.

<Multi-Color, Full-Color Image>

For obtaining multi-color images or full-color images, first, a heat transfer sheet is prepared which comprises a cyan image formation layer, a magenta image formation layer and a yellow image formation layer formed sequentially on a support. Alternatively, a monochrome heat transfer sheet having a cyan image formation layer on a support, a monochrome heat transfer sheet having a magenta image formation layer on a support, and a monochrome heat transfer sheet having a yellow image formation layer on a support, are prepared.

Then, an image receiving material is fixed on a substrate by suction action, and a heat transfer sheet is laminated thereon. In the case of formation of multi-color images or full-color images, it is necessary to repeatedly change the heat transfer sheet under a condition in which an image receiving material is closely adhered to a substrate by suction. Therefore, for forming images in a short period of time, it is preferable not to use a cover sheet.

As described above, irradiation with light is effected image-wise to form, for example, cyan images on the surface of an image receiving material, and a heat transfer sheet is peeled from the surface of an image receiving material. Then, a heat transfer sheet having a different color is laminated, and irradiation with light is effected image-wise in the same manner as described above, to form, for example, magenta images. After formation of the images, this heat transfer sheet is peeled from an image receiving material, and a heat transfer sheet having another color is laminated to the image receiving material. Then, irradiation with light is effected image-wise, to form, for example, yellow images.

It is necessary to fix an image receiving material on a substrate so as not to cause color displacement during the changing of the plurality of heat transfer sheets. Therefore, it is desirable that the surface of a substrate is formed, for example, with sticky material, and an image receiving material is fixed on a substrate by suction force generated due to exhaustion even at the time when the heat transfer sheets are changed.

Further, when an image receiving material has a cushioning layer formed of a shape memory resin, the cushioning layer is heated in order to recover the shape thereof after each color transfer.

Also in the case of transferring images to an image receiving material used as an intermediate transfer body, the above-mentioned method can be used. By using the image receiving material used as an intermediate transfer body obtained in this manner which has images on the surface, precise image can be formed even on the final image receiving material whose surface is not smooth.

EXAMPLES

The following examples illustrate the present invention, but do not limit the scope of the present invention. Unless otherwise stated, "parts" refers to parts by weight.

Example 1

1) Preparation of Coating Solution of Light-Heat-Conversion Layer

The following components were mixed while being stirred with a stirrer to prepare a coating solution of a light-heat-conversion layer.

[Composition of Coating Solution]

| | |
|---|---|
| Light-heat-conversion substance (Infrared light absorbing colorant A described below) | 10 parts |
| Additive: triphenyl phosphate | 5 parts |
| Polyimide resin (Rikacoat SN-20, manufactured by New Japan Chemical Co., Ltd.) | 200 parts |
| N-methyl-2-pyrrolidone | 2000 parts |
| Surfactant (Megafac F-177, manufactured by Dainippon Ink and Chemicals Inc.) | 1 part |

Infrared Light Absorbing Colorant A

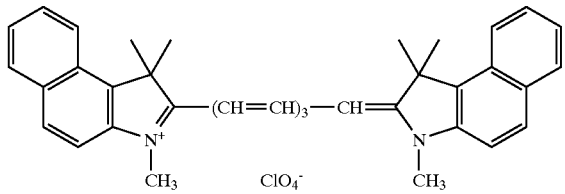

2) Formation of Light-Heat-Conversion Layer on Surface of Support

On one surface of a polyethylene terephthalate film having a thickness of 100 μm, the above-mentioned coating solution was applied using a rotating coating machine (Whiler), then, the coated product was dried for 2 minutes in an oven at 100° C., to form a light-heat-conversion layer on the support. The absorption maximum of the obtained light-heat-conversion layer was in the wavelength range from 700 to 1000 nm and near 830 nm, and the absorption (optical density; OD) was measured by a Macbeth densitometer and found to be 1.0. When a section of the light-heat-conversion layer was observed by a scanning electron microscope, the average film thickness was 0.3 μm.

3) Preparation of Coating Solution for Yellow Image Formation Layer

The following components were dispersed for 2 hours by a paint shaker (manufactured by Toyo Seiki K.K.), then, glass beads were removed, to prepare a yellow pigment dispersion mother liquor.

[Composition of Pigment Dispersion Mother Liquor]

| | |
|---|---|
| 20 wt % solution of polyvinyl butyral (manufactured by Denki Kagaku Kogyo K.K., Denka Butyral #2000-L, vicat softening point 57° C.) | 12.6 parts |
| Coloring material (Yellow pigment (C. I. PY. 14)) | 24 parts |
| Dispersion aid (Solsperse S-20000, manufactured by ICI K.K.) | 0.8 parts |
| n-propyl alcohol | 110 parts |
| Glass beads | 100 parts |

The following components were mixed by being stirred with a stirrer to prepare a coating solution of a yellow image formation layer.

[Composition of Coating Solution]

| | |
|---|---|
| The pigment dispersion mother liquor | 20 parts |
| n-propyl alcohol | 60 parts |
| Surfactant (Megafac F-176PF, manufactured by Dainippon Ink and Chemicals Inc.) | 0.05 parts |

4) Formation of Yellow Image Formation Layer on Surface of Light-Heat-Conversion Layer On the surface of the above-mentioned light-heat-conversion layer, the above-mentioned coating solution was applied using Whiler for 1 minute, then, the coated product was dried for 2 minutes in an oven at 100° C. to form a yellow image formation layer (pigment 64.2% by weight, polyvinyl butyral 33.7% by weight) on the light-heat-conversion layer. The absorption (optical density; OD) of the obtained image formation layer was measured by a Macbeth densitometer and OD was found to be 0.7. The same measurement as described above was conducted and the average film thickness was found to be 0.4 $\mu$m. By the above-described process, a heat transfer sheet comprising the light-heat-conversion layer and the yellow image formation layer provided in this order on the support was formed.

<Production of Image Receiving Material>

1) Preparation of Coating Solution of First Image Receiving Layer

The following components were mixed while being stirred with a stirrer to prepare a coating solution of a first image receiving layer.

[Composition of Coating Solution]

| | |
|---|---|
| Polyvinyl chloride (Xeon 25, manufactured by Nippon Xeon Co., Ltd.) | 9 parts |
| Surfactant (Megafac F-177P, manufactured by Dainippon Ink and Chemicals Inc.) | 0.1 part |
| Methyl ethyl ketone | 130 parts |
| Toluene | 35 parts |
| Cyclohexane | 20 parts |
| Dimethylformamide | 20 parts |

2) Formation of First Image Receiving Layer on Surface of Support

On one surface of a support (polyethylene terephthalate film having a thickness of 75 μm), the above-mentioned coating solution was applied using Whiler, then, the coated product was dried for 2 minutes in an oven at 100° C., to form a first image receiving layer (thickness 1 μm) on the support.

3) Preparation of a Coating Solution of a Second Image Receiving Layer

The following components were mixed while being stirred with a stirrer to prepare a coating solution of a second image receiving layer.

[Composition of Coating Solution]

| | |
|---|---|
| Methyl methacrylate/ethyl acrylate/methacrylic acid copolymer (Dianal BR-77, manufactured by Mitsubishi Rayon Co., Ltd.) | 17 parts |
| Alkyl acrylate/alkyl methacrylate copolymer (Dianal BR-64, manufactured by Mitsubishi Rayon Co., Ltd.) | 17 parts |
| Pentaerythritol tetraacrylate (A-TMMT, manufactured by Shin Nakamura Kagaku K.K.) | 22 parts |
| Surfactant (Megafac F-177P, manufactured by Dainippon Ink and Chemicals Inc.) | 0.4 part |
| Methyl ethyl ketone | 100 parts |
| Hydroquinone monomethyl ether | 0.05 parts |
| 2,2-dimethoxy-2-phenylacetophenone | 1.5 parts |

4) Formation of Second Image Receiving Layer on Surface of First Image Receiving Layer On the surface of the first image receiving layer, the above-mentioned coating solution was applied using Whiler, then, the coated product was dried for 2 minutes in an oven at 100° C., to form a second image receiving layer (thickness 26 μm) on the first image receiving layer. By the above-mentioned process, an image receiving material having two image receiving layers laminated on a support was produced.

<Production of Light-Heat-Conversion Type Image Formation Material and Evaluation of Laser Heat Transfer Property>

1) Measurement of Sensitivity

On a rotating drum provided with suction holes for vacuum suctioning, the heat transfer sheet and image receiving material were laminated and wound so that the image receiving material side contacted the surface of the drum to thereby obtain a light-heat-conversion type image formation material. The light-heat-conversion type image formation material was fixed on the surface of the drum by evacuating the inside of the drum. While rotating the dum, a semiconductor laser beam was focused on the surface of the light-heat-conversion type image formation material on the drum so that the diameter of the spot was 7 μm on the surface of the light-heat-conversion layer. The beam was allowed to move along a direction perpendicular to the rotating direction (main scanning direction) of the rotating drum(sub-scanning), to thereby carry out conduct recording of images (image lines) on the light-heat-conversion type image formation material. The laser irradiation conditions are as described below.

| | |
|---|---|
| Laser power: | 110 mW |
| Main scanning speed: | 4 m/sec. |
| Sub scanning pitch (sub scanning amount per rotation): | 20 μm |

The light-heat-conversion type image formation material on which the above-mentioned laser image recording was carried out was removed from the drum, the image receiving material and heat transfer sheet were separated manually, and checked to confirm that only parts irradiated with the laser of the image (image line) formation layer had been transferred from the transfer sheet to the image receiving material. The transferred images were observed by an optical electron microscope and it was found that the laser irradiated portion were recorded in the form of lines. The width of this recorded line was measured, and sensitivity was calculated according to the following formula. The results are shown in Table 1.

Sensitivity=(laser power P)/(line width d×line speed v)

The lower the value obtained from the above-mentioned formula, the better the sensitivity.

2) Evaluation of Resolution

Sharpness of the image of the sample on which lines had been recorded in the evaluation of sensitivity was judged according to the following criteria. The results are shown in Table 1.

◎ very sharpness is excellent

○ sharpness is standard

Δ sharpness is slightly poor

X sharpness is poor

XX sharpness is extremely poor

Example 2

A heat transfer sheet and a light-heat-conversion material were produced in the same manner as in Example 1 except that the compound added to the light-heat-conversion layer was replaced by 5 parts of trilauryl phosphite, and then evaluation of the laser transfer property was conducted. The results are shown in Table 1.

Example 3

A heat transfer sheet and a light-heat-conversion material were produced in the same manner as in Example 1 except that the compound added to the light-heat-conversion layer was replaced by 5 parts of trimellitic anhydride mono-acid chloride, and then evaluation of the laser transfer property was conducted. The results are shown in Table 1.

Example 4

A heat transfer sheet and a light-heat-conversion material were produced in the same manner as in Example 1 except that the compound added to the light-heat-conversion layer was replaced by 5 parts of toluene diisocyanate, and then evaluation of the laser transfer property was conducted. The results are shown in Table 1.

Comparative Example 1

A heat transfer sheet and a light-heat-conversion material were produced in the same manner as in Example 1 except that no additive were added to the light-heat-conversion layer, and then evaluation of the laser transfer property was conducted. The results are shown in Table 1.

TABLE 1

| | | After one day at room temperature | | After three days at 40° C. and 70% | |
|---|---|---|---|---|---|
| | Compound added to light-heat-conversion layer | Sensitivity | Resolution | Sensitivity | Resolution |
| Example 1 | Triphenyl phosphate | 250 | ○ | 250 | ○ |
| Example 2 | Trilauryl phosphite | 265 | ○ | 260 | ○ |
| Example 3 | Trimellitic anhydride mono-acid chloride | 260 | ○ | 270 | ○ |
| Example 4 | Toluene diisocyanate | 250 | ○ | 255 | ○ |
| Comparative example 1 | None | 255 | ○ | 360 | X |

*Unit: sensitivity (mJ/cm$^2$)

As shown in Table 1, heat transfer sheets after one day at room temperature and heat transfer sheets after three days under conditions of 70% humidity and a temperature of 40° C. were evaluated. The results show that the heat transfer sheets in Examples 1 to 4 have more favorable sensitivities and resolutions than those in Comparative Example 1.

Example 5

A heat transfer sheet and a light-heat-conversion material were produced in the same manner as in Example 1 except that the compound added to the light-heat-conversion layer was replaced by 3 parts of trimellitic acid, and then evaluation of the laser transfer property was conducted. The results are shown in Table 2.

Example 6

A heat transfer sheet and a light-heat-conversion material were produced in the same manner as in Example 1 except that the compound added to the light-heat-conversion layer was replaced by 3 parts of p-toluenesulfonic acid, and then evaluation of the laser transfer property was conducted. The results are shown in Table 2.

Example 7

A heat transfer sheet and a light-heat-conversion material were produced in the same manner as in Example 1 except that the compound added to the light-heat-conversion layer was replaced by 3 parts of polymethacrylic acid, and then evaluation of the laser transfer property was conducted. The results are shown in Table 2.

Comparative Example 2

A heat transfer sheet and a light-heat-conversion material were produced in the same manner as in Example 1 without adding and additive to the light-heat-conversion layer, and then evaluation of the laser transfer property was conducted. The results are shown in Table 2.

TABLE 2

| | | After one day at room temperature | | After three days at 40° C. and 70% | |
|---|---|---|---|---|---|
| | Compound added to light-heat-conversion layer | Sensitivity | Resolution | Sensitivity | Resolution |
| Example 5 | Trimellitic acid | 265 | ○ | 270 | ○ |
| Example 6 | p-Toluenesulfonic acid | 255 | ○ | 260 | ○ |
| Example 7 | Polymethacrylic acid | 260 | ○ | 260 | ○ |
| Comparative example 2 | None | 255 | ○ | 360 | X |

*Unit: sensitivity (mJ/cm$^2$)

As shown in Table 2, heat transfer sheets after one day at room temperature and heat transfer sheets after three days under conditions of 70% humidity and a temperature of 40° C. were evaluated. The results show that the heat transfer sheets in Examples 5 to 7 have more favorable sensitivities and resolutions than those in Comparative Example 2.

Example 8

<Production of Heat Transfer Sheet>

1) Preparation of Coating Solution of Light-Heat-Conversion Layer

The following components were mixed and heated while being stirred with a stirrer to prepare a coating solution of a light-heat-conversion layer.

[Composition of Coating Solution]

| | |
|---|---|
| Methyl ethyl ketone | 800 parts by weight |
| N-methyl-2-pyrrolidone | 1200 parts by weight |
| Surfactant (F-177, manufactured by Dainippon Ink and Chemicals Inc.) | 1 part by weight |
| Infrared light absorbing colorant (NK-2014, manufactured by Nippon Kanko Shikiso K.K.) | 10 parts by weight |
| Polyimide resin (Rikacoat SN-20, manufactured by New Japan Chemical Co., Ltd.) | 200 parts by weight |
| Compound A-1 described in TABLE 1 (Additive) | 5 parts by weight |

2) Formation of Light-Heat-Conversion Layer on Surface of Support

On one surface of a polyethylene terephthalate film having a thickness of 75 μm, the above-mentioned coating solution was applied using a rotating coating machine (Whiler), then, the coated product was dried for 2 minutes in an oven at 100° C., to form a light-heat-conversion layer on the support. The obtained light-heat-conversion layer had an absorption maximum near 830 nm in the wavelength range from 700 to 1000 nm, and the absorption (optical density; OD) was measured by a spectrophotometer and OD was found to be 1.0. A section of the light-heat-conversion layer was observed by a scanning electron microscope and the average film thickness was 0.3 μm.

3) Preparation of Pigment Dispersion Mother Liquor

Next, pigment dispersion mother liquor A to D using the following four kinds of pigments respectively were prepared.

[Composition of Pigment Dispersion Mother Liquor]

| | |
|---|---|
| Polyvinyl butyral (Denka Butyral #2000-L, vicat softening point 57° C., manufactured by Denki Kagaku Kogyo K.K.) | 12 parts by weight |
| Pigment | |
| A. Cyan pigment (CI. P. B. 15:4) | 15 parts by weight |
| B. Magenta pigment (CI. P. R. 57:1) | 15 parts by weight |
| C. Yellow pigment (CI. P. Y. 14) | 15 parts by weight |
| D. Black pigment (MA-100, manufactured by Mitsubishi Chemical Co., Ltd.) | 15 parts by weight |
| Dispersion aid (Solsperse S-20000, manufactured by ICI K.K.) | 0.8 parts |
| Solvent n-propyl alcohol | 110 parts |

4) Formation of Image Formation Layer on Surface of Light-Heat-Conversion Layer 10 parts by weight of each of the above-mentioned pigment dispersion mother liquor A, B, C, and D, respectively were added to 0.24 parts by weight of stearic amide, a rosin resin (Rosin KE311, manufactured by Arakawa Kagaku K.K.), 0.4 parts by weight of the above-mentioned polyvinylbutyral resin, 0.045 parts by weight of a surfactant (F-177, manufactured by Dainippon Ink and Chemicals Inc.), and 100 parts by weight of n-propyl alcohol to give coating solutions for an image formation layer. The solutions were coated on the light-heat-conversion layer so that thickness of the dry film of the pigment dispersion mother liquor A was 0.4 μm. The other coating solutions were also coated so that the thickness of the dry film was 0.4 μm for B, 0.4 μm for C and 0.35 μm for D, respectively, to obtain heat transfer sheets of the present invention.

The above-mentioned heat transfer sheets were left for one day at room temperature (23° C., relative humidity 50%) or for three days under conditions of a temperature of 40° C. and a relative humidity of 70%. Absorption of the light-heat-conversion layers of these heat transfer sheets were 1.0=OD (after one day) and 1.05=OD (after three days), respectively, indicating no change.

<Production of Image Receiving Material>

Coating solutions for a cushioning intermediate layer and an image receiving material layer having the following compositions were prepared.

[Composition of Coating Solution for Forming Cushioning Intermediate Layer]

| | |
|---|---|
| Vinyl chloride-vinyl chloride copolymer (MPR-TSL, manufactured by Nisshin Kagaku K.K.) | 25 parts by weight |
| Plasticizer 6-functional acrylate monomer (DPCA-120, molecular weight 1947, manufactured by Nippon Kayaku Co., Ltd.) | 12 parts by weight |
| Surfactant (Megafac F-177, manufactured by Dainippon Ink and Chemicals Inc.) | 0.4 parts by weight |
| Methyl ethyl ketone | 75 parts by weight |
| [Composition of coating solution for image receiving layer] | |
| Polyvinyl butyral (Denka Butyral #2000-L, manufactured by Denki Kagaku Kogyo K.K.) | 16 parts by weight |
| Surfactant (Megafac F-177, manufactured by Dainippon Ink and Chemicals Inc.) | 0.5 parts by weight |
| n-propyl alcohol | 200 parts by weight |

The above-mentioned coating solution for forming a cushioning intermediate layer was coated on a white PET support [Void base] (Lumilar E-68L, manufactured by Toray Industries Inc.) by using a small width coating machine, and the coated layer formed by this coating was dried to form a cushioning intermediate layer. Then, a coating solution of an image receiving layer was coated on this cushioning intermediate layer, and the coated layer formed by this coating was dried to form an image receiving layer. The thickness of the cushioning intermediate layer after drying was about 20 μm, and the film thickness of the image receiving layer was about 2 μm.

<Evaluation of Laser Heat Transfer Property>

1) Measurement of Recording Sensitivity

On a rotating drum having a diameter of 25 cm and provided with suction holes having a diameter of 1 mm (surface density of 1 per 3 cm×3 cm area) for vacuum suction, the above-mentioned image receiving materials (25 cm×35 cm) wound and suctioned. Then, a heat transfer sheet having 30 cm×40 cm was laminated so that it extended uniformly from the image receiving material, and the heat transfer sheet was allowed to be adhered closely by squeezing with a squeeze roller so that air was sucked through the suction holes. The image receiving material and the heat transfer sheet were thereby laminated to obtain a light-heat-conversion type image formation material. The degree of vacuum when the suction holes were clogged was ⁻150 mmHg per unit of atmospheric pressure.

While rotating the drum, a semiconductor laser beam having a wavelength of 830 nm was focused on the surface of the light-heat-conversion type image formation material on the drum so that the diameter of the spot was 7 μm on the surface of the light-heat-conversion layer. The beam was allowed to move along a direction perpendicular to the rotating direction (main scanning direction) of the rotating drum (sub-scanning). Recording of laser images (image lines) on the light-heat-conversion type image formation material was thereby carried out. The laser irradiation conditions are as described below.

[Laser Irradiation Conditions]

| | |
|---|---|
| Laser power: | 110 mW |
| Main scanning speed: | 4 m/sec. |
| Sub scanning pitch (sub scanning amount per rotation): | 20 μm |

Temperature, humidity: 25° C., relative humidity 50%

The light-heat-conversion type image formation material on which the above-mentioned laser image recording was carried out was removed from the drum, the image receiving material and heat transfer sheet were separated manually, and it was confirmed that only parts irradiated with the laser of the image (image line) formation layer had been transferred from the transfer sheet to the image receiving material. The transferred images were observed by an optical microscope to find the laser irradiation parts recorded in the form of lines. The width of this recorded line was measured, and sensitivity was calculated according to the following formula. The results are shown in Table 4.

$$\text{Sensitivity}=(\text{laser power P})/(\text{line width d}\times\text{line speed v})$$

The lower the value obtained from the above-mentioned formula, the better the sensitivity.

2) Evaluation of Resolution

Resolution of the formed images was judged according to the following criteria. The results are shown in Table 4.

[Criteria]

◎ Excellent resolution for use could be obtained

○ Good resolution for use could be obtained

Δ Resolution causing no problem for use could be obtained

X Sufficient resolution could not be obtained

Examples 9 to 15

Heat transfer sheets and image receiving materials according to Examples 9 to 15 were produced in the same manner as in Example 8 except that the additive A-1 added to the light-heat-conversion layer was replaced by the compounds A-2 to C-3 shown in Table 3, and then evaluation of the laser heat transfer property was conducted. The results are shown in Table 4.

Comparative Example 3

A heat transfer sheet and image receiving material according to Comparative Example 1 were produced in the same manner as in Example 8 except that no additive was added to the light-heat-conversion layer, and then evaluation of the laser heat transfer property was conducted. The results are shown in Table 4.

TABLE 3

| | compound | Structural formula |
|---|---|---|
| Example 8 | A-1 | 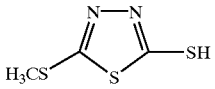 |
| Example 9 | A-2 | 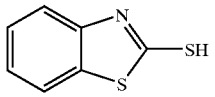 |
| Example 10 | B-1 | 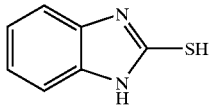 |
| Example 11 | B-2 | 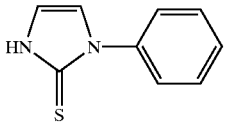 |
| Example 12 | B-3 | 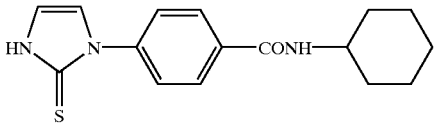 |
| Example 13 | C-1 | 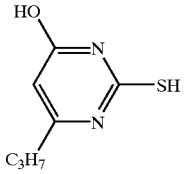 |
| Example 14 | C-2 | 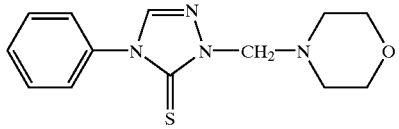 |
| Example 15 | C-3 | 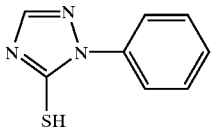 |

TABLE 4

| | | After one day at room temperature | | | After three days at 40° C. and 70% humidity | | |
|---|---|---|---|---|---|---|---|
| | Additive | Sensitivity | Resolution | OD | Sensitivity | Resolution | OD |
| Example 8 | Compound A-1 | 260 | ◎ | 1.0 | 255 | ◎ | 1.0 |
| Example 9 | Compound A-2 | 255 | ◎ | 1.0 | 260 | ◎ | 0.99 |
| Example 10 | Compound B-1 | 255 | ○ | 0.98 | 265 | ○ | 0.94 |
| Example 11 | Compound B-2 | 260 | ○ | 0.95 | 270 | Δ | 0.90 |
| Example 12 | Compound B-3 | 255 | ○ | 0.98 | 265 | ○ | 0.94 |
| Example 13 | Compound C-1 | 255 | ○ | 0.98 | 265 | ○ | 0.94 |

TABLE 4-continued

| | | After one day at room temperature | | | After three days at 40° C. and 70% humidity | | |
|---|---|---|---|---|---|---|---|
| | Additive | Sensitivity | Resolution | OD | Sensitivity | Resolution | OD |
| Example 14 | Compound C-2 | 260 | ○ | 0.95 | 270 | Δ | 0.90 |
| Example 15 | Compound C-3 | 255 | ○ | 0.98 | 265 | ○ | 0.94 |
| Comparative example 3 | None | 255 | ○ | 0.90 | 360 | X | 0.80 |

*Unit: sensitivity (mJ/cm$^2$)

According to the present invention, decomposition of an infrared light absorbing colorant with the lapse of time when the heat transfer sheet is stored, can be suppressed by inclusion of additives in a light-heat-conversion layer. By this, reduction in image density with the lapse of time can be prevented, and resolution can be improved. Consequently, a heat transfer sheet can be provided in which a recorded image having excellent stability in storage, and showing little variation in sensitivity and resolution can be obtained.

What is claimed is:

1. A heat transfer sheet comprising a light-heat-conversion layer which includes an infrared light absorbing colorant and an image formation layer, the layers being provided in that order on a support, wherein said light-heat-conversion layer further includes one or more compounds represented by the following formula (1) or (2):

Formula (1)

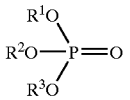

Formula (2)

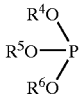

wherein $R^1$, $R^2$, $R^3$, $R^4$, $R^5$, and $R^6$ represent a hydrogen atom, an unsubstituted alkyl group or an unsubstituted aryl group.

2. The heat transfer sheet according to claim 1, wherein said image formation layer comprises a pigment and an amorphous organic polymer having a softening temperature in the range from 40 to 150° C. in amounts of 20 to 80% by weight respectively, and has a layer thickness in the range from 0.2 to 1.5 $\mu$m.

3. A light-heat-conversion type image formation material comprising a heat transfer sheet and an image receiving material, wherein said heat transfer sheet comprises a light-heat-conversion layer which includes an infrared light absorbing colorant and an image formation layer, the layers are provided in that order on a support, and said light-heat-conversion layer further includes one or more compounds represented by the following formula (1) or (2):

Formula (1)

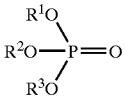

Formula (2)

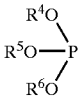

wherein $R^1$, $R^2$, $R^3$, $R^4$, $R^5$ and $R^6$ represent a hydrogen atom, an unsubstituted alkyl group or an unsubstituted aryl group.

* * * * *